US005973602A

United States Patent [19]

Cole, III et al.

[11] Patent Number: 5,973,602

[45] **Date of Patent: *Oct. 26, 1999**

[54] METHOD AND APPARATUS FOR MONITORING TEMPERATURE CONDITIONS IN AN ENVIRONMENT

[75] Inventors: John W. Cole, III, 7 Pleasantview Dr., Marble Dale, Conn. 06777; Patrick H. Ryan, Jr., Atlanta, Ga.

[73] Assignees: John W. Cole, III; Danielle K. Cole; Boyd F. Cole

[ * ] Notice: This patent is subject to a terminal disclaimer.

[21] Appl. No.: 09/082,630

[22] Filed: May 21, 1998

Related U.S. Application Data

[63] Continuation of application No. 08/056,375, Apr. 30, 1993, Pat. No. 5,635,909.

[51] Int. Cl.[6] ..... G08B 17/00

[52] U.S. Cl. ..... 340/584; 340/586; 340/589; 340/693.5; 2/93

[58] Field of Search ..... 340/586, 584, 340/588, 589, 573.1, 693.5; 2/93, 2.5, 5, 7, 8

[56] References Cited

U.S. PATENT DOCUMENTS

| | | | |
|---|---|---|---|
| 3,802,249 | 4/1974 | Clawson | 73/1 F |
| 4,884,222 | 11/1989 | Nagashima et al. | 340/588 |
| 5,157,378 | 10/1992 | Stumberg et al. | 340/586 |
| 5,188,267 | 2/1993 | Sargent et al. | 224/215 |
| 5,382,943 | 1/1995 | Tanaka | 340/693.5 |
| 5,450,066 | 9/1995 | Brighenti et al. | 340/589 |
| 5,539,381 | 7/1996 | Johnson | 340/588 |
| 5,592,147 | 1/1997 | Wong | 340/628 |
| 5,635,909 | 6/1997 | Cole | 340/586 |

*Primary Examiner*—Jeffery A. Hofsass
*Assistant Examiner*—Anh La
*Attorney, Agent, or Firm*—Rockey, Milnamow & Katz, Ltd.

[57] ABSTRACT

A temperature monitoring system incorporated in a firefighter's turnout coat, vest or self-contained breathing apparatus to provide protective garments or equipment that can determine the rate of increase of the temperatures in the environment and compare the rate of temperature increase to at least one predetermined threshold and provide a warning when the rate of temperature increase exceeds the predetermined threshold.

9 Claims, 6 Drawing Sheets

200
SN = 1
202
TEMP (SN)
204
PT(SN) = TEMP(SN)
206
IF TEMP(SN) < 100⁰
208
Y
N
IF TEMP(SN) > 300⁰
212
ALARM FULL
ROR(SN) = ([TEMP(SN) - PT(SN)]) / TIME INTERVAL
214
IF TEMP(SN) > 250⁰
216
IF ROR(SN) > 0
218
ALARM FULL
220
ALARM INTERMITTANT
222
IF TEMP(SN) > 200⁰
224
IF ROR(SN) ≥ 0.5
221
ALARM FULL
228
ALARM INTERMITTANT
230
IF TEMP(SN) > 150⁰
232
IF ROR(SN) ≥ 1
234
ALARM FULL
236
IF TEMP(SN) ≥ 100⁰
238
IF ROR(SN) ≥ 1.5
240
ALARM FULL
244
PT(SN) = TEMP(SN)
210
SN = SN+1
240
IF SN > THE NUMBER OF SENSORS
242
SN = 1
244
TEMP(SN)
246

METHOD AND APPARATUS FOR MONITORING TEMPERATURE CONDITIONS IN AN ENVIRONMENT

This is a continuation of application U.S. Ser. No. 08/056,375, filed Apr. 30, 1993, now U.S. Pat. No. 5,635,909.

FIELD OF THE INVENTION

The present invention relates to a protective garment for firefighters, and more particularly to a firefighter's turnout coat equipped with a system for monitoring temperature conditions to which the firefighter is subjected.

BACKGROUND OF THE INVENTION

For many years, firefighters have worn protective uniforms or garments to protect themselves from excessive and hazardous temperatures that occur during a fire. While these protective garments have become proficient at insulating the firefighter from potentially hazardous temperatures, these garments have also reduced the firefighter's ability to sense changing conditions of the environment.

In the past, firefighters detected extreme temperatures with their earlobes, which were the only part of the body exposed to the atmosphere. However, firefighters now wear turnout coats, hoods, helmets, and boots that cover the entire body, leaving no body parts for detecting extreme temperatures.

In any event, firefighters can only operate for a relatively short period of time in environments having temperatures above certain levels. When firefighters are exposed to excessive temperatures for a prolonged period of time, firefighters may be injured and the firefighter's uniform may be damaged.

Substantial improvements in the protection of firefighters from exposure to excessive temperatures are disclosed and claimed in U.S. Pat. No. 5,635,909. That patent is directed to a protective garment for use by firefighters, and more particularly to a firefighter's turnout coat which includes an interior temperature sensing circuit programmed to generate a signal when the temperature in the firefighter's environment exceeds a predetermined limit. That permits the firefighter's coat to generate an audible signal to alert the firefighter wearing the garment that the temperature has exceeded that preset limit.

SUMMARY OF THE INVENTION

The concepts of the present invention reside in a firefighter's turnout coat which includes temperature monitoring apparatus that not only alerts the firefighter when the environment in which he or she is working has exceeded a predetermined limit but also alerts the firefighter when the rate of increase in the temperature of the environment likewise exceeds a predetermined level. It has been found that both functions are particularly desirable to warn a firefighter of excessive temperatures and of temperatures whose rate of increase is too rapid.

The firefighter's turnout coat of the present invention includes an exterior heat resistant shell and an interior lining. The interior lining is fitted with an electronic temperature monitoring unit which includes at least one electronic temperature sensing circuit having at least one input and one output and at least one logic circuit between the input and output. The logic circuit is configured to determine if the input has exceeded a predetermined limit and then causes a signal to be sent to the output if the predetermined level has been exceeded.

The logic circuit is further configured to include at least one temperature sensor to generate an electrical output indicative of the temperature of the environment to determine if the rate of increase in the temperature of the environment has exceeded a predetermined level. The logic circuit detects successive representations of a plurality of sampled sensor outputs at preselected time intervals, computes the rate of temperature change between the successive representations and compares the rate of temperature change to at least one predetermined threshold. If the rate of temperature change exceeds the predetermined threshold, a signal is sent to the output.

The turnout coat of the present invention also includes at least one temperature sensor positioned between the exterior heat resistant shell and interior lining. The temperature sensor is electrically connected to the input of the electronic sensing circuit. The turnout coat further includes at least one alarm device electrically connected to the output of the electronic temperature sensing circuit which causes an alarm signal when either the input or the rate of temperature change exceed their respective predetermined levels.

One object of the present invention is to provide a firefighter's turnout coat which has a reliable warning system for firefighters and other professionals working in potentially dangerous high temperature environments.

Another object of the present invention is to provide a firefighter's turnout coat having a reliable warning system which alerts the firefighter when the environment in which he or she is working has exceeded a predetermined limit and further alerts the firefighter when the rate of increase in the temperature of the environment likewise exceeds a predetermined level.

A further object of the present invention is to provide a firefighter's turnout coat having a reliable warning system in which all of the components of the electronic temperature alarm system are insulated from damaging high temperatures by being located inside the coat's heat insulating shell.

A still further object of the present invention is to provide other equipment for a firefighter, such as a vest or a self-contained breathing apparatus (SCBA), having a reliable warning system as described above.

DETAILED DESCRIPTION OF THE INVENTION

Figure 1:
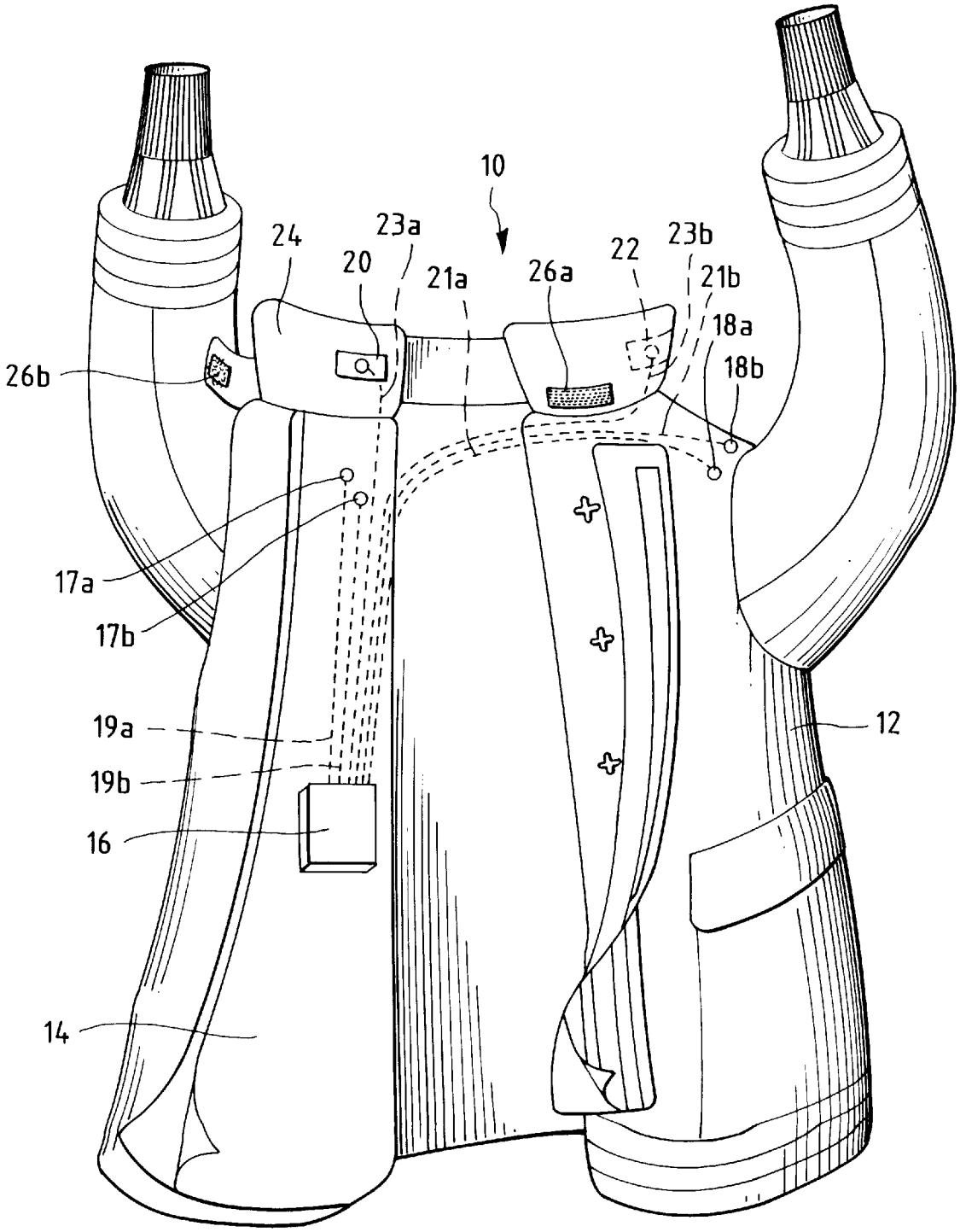
FIG. 1 is a diagrammatic perspective view of a firefighter's turnout coat which is one of the embodiments of the present invention.

The present invention relates to a firefighter's turnout coat having a temperature monitoring system incorporated therein. FIG. 1 illustrates the firefighter's coat with the temperature monitoring system, one embodiment of the present invention. It will be recognized by those skilled in the art, however, that the monitoring system of the present invention can also be attached to a firefighter's shoulder harness, pants, vest, straps of a self contained-breathing apparatus, or any other suitable portion of the firefighter's uniforms without departing from the spirit of the invention.

Referring now to FIG. 1, a firefighter's turnout coat is shown having an exterior heat resistant shell 12, preferably made from a fabric manufactured by DuPont and sold under the trademark Nomex™. The coat 10 has an interior lining 14 which is adapted to hold and allow access to an electronic circuit housing 16 from inside the coat. In this embodiment, positioning of the electronic circuit housing inside the coat 10 protects the electronic temperature sensing circuit within the electronic circuit housing 16 from the environment firefighters experience, namely high temperatures and falling debris.

The coat 10 illustrated in FIG. 1 includes four temperature sensors 17*a*, 17*b*, 18*a* and 18*b*, illustrated by dashed lines, located between the interior lining 14 and the exterior heat resistant shell 12. Such positioning allows the sensors to measure the effect of the surrounding environment on the exterior heat resistant shell 12. Thermistors and polymeric thin film RTD type temperature sensors used in the present invention are well known in the art. Additionally, while only one temperature sensor is needed to practice the present invention, the plurality of sensors illustrated provides flexibility in configuring the temperature sensing circuit for redundancy or indications of different degrees of danger or a combination of both.

The coat 10 further includes a first speaker 20 and a second speaker 22, illustrated by dashed lines, located on the inside surface of collar 24 so as to be aimed directly at a wearer's ears when the collar 24 is held closed by closure means 26*a* and 26*b*, such as Velcro hook-and-loop area fasteners. Speakers 20 and 22 are preferably piezo electric type speakers because they provide sound pressure levels of 90 dB at 20 cm, levels sufficient to alert a wearer in a noisy environment. As an alternative, the speakers can be placed directly on the electronic circuit housing. It will be appreciated by those skilled in the art that both the temperature sensors and speakers can be positioned on the parts of the coat 10 without departing from the spirit of the present invention.

As further shown in FIG. 1, located between the exterior heat resistant shell 12 and the interior lining 14 are a plurality of electrical conductors 19*a*, 19*b*, 20*a* and 20*b*. Electrical conductors 19*a*, 19*b*, 20*a* and 20*b* connect the temperature sensors 17*a*, 17*b*, 18*a* and 18*b* to an electronic sensing circuit (not show) housed within the electronic sensing circuit housing 16. Two conductors 23*a* and 23*b* connect speakers 20 and 22 to the electronic sensing circuit.

Figure 2:
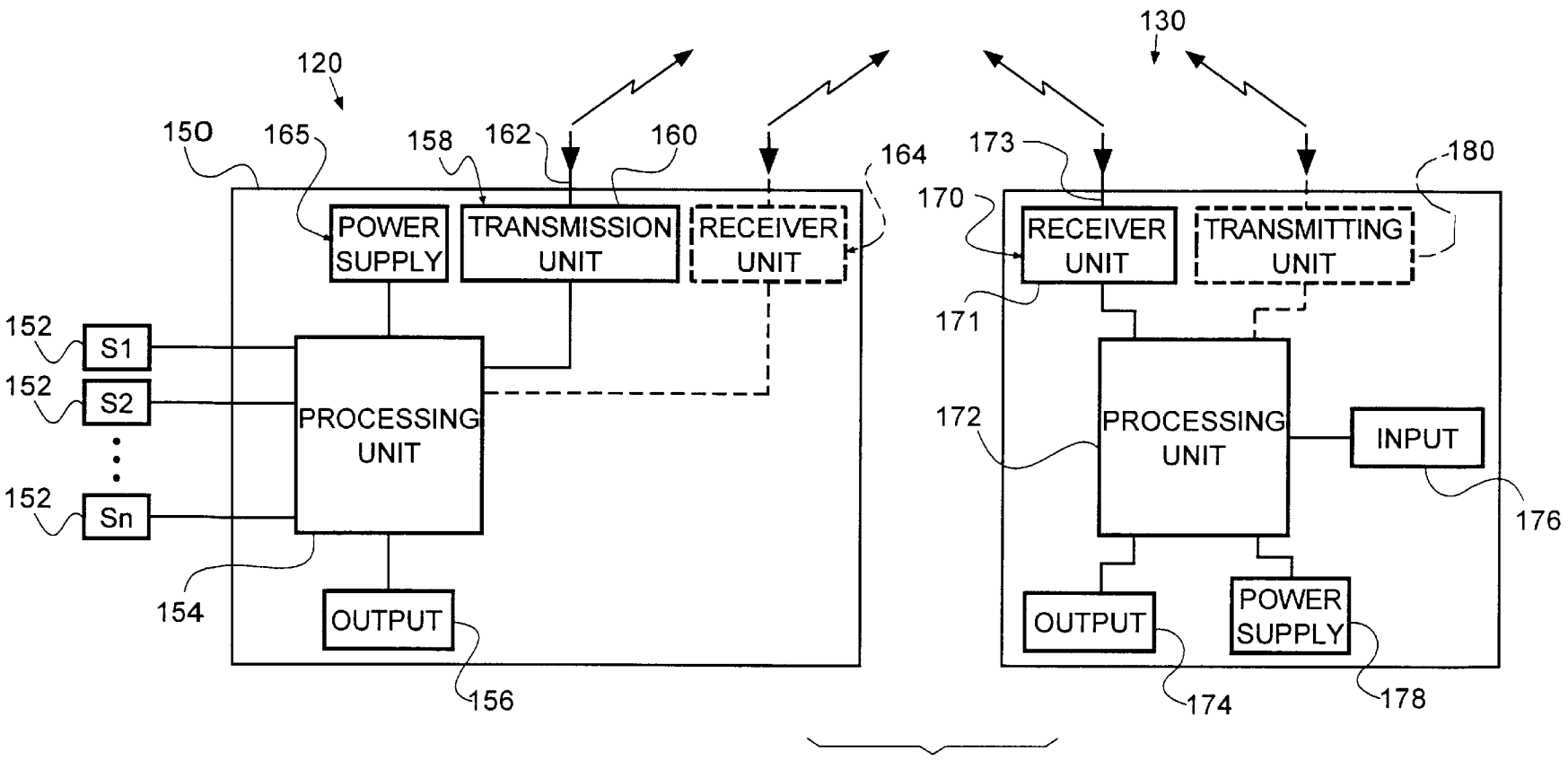
FIG. 2 is a schematic block diagram of the components of a temperature monitoring unit and a central processing unit of the monitoring apparatus used in the turnout coat of FIG. 1.

FIG. 2 illustrates a temperature monitoring apparatus used to monitor and determine temperature conditions in various environments. The temperature monitoring apparatus preferably includes one or more temperature monitoring units 120 and a central processing unit 130. In the preferred embodiment of the present invention, temperature monitoring unit 120 and central processing unit 130 are located within the turncoat 10 of FIG. 1. It will be recognized by those skilled in the art that the temperature monitoring apparatus can be attached to the other areas of equipment worn by the firefighter as well as to equipment used by the firefighter (i.e., fire hoses, ladders, etc.) without departing from the spirit of the present invention.

Figure 3:
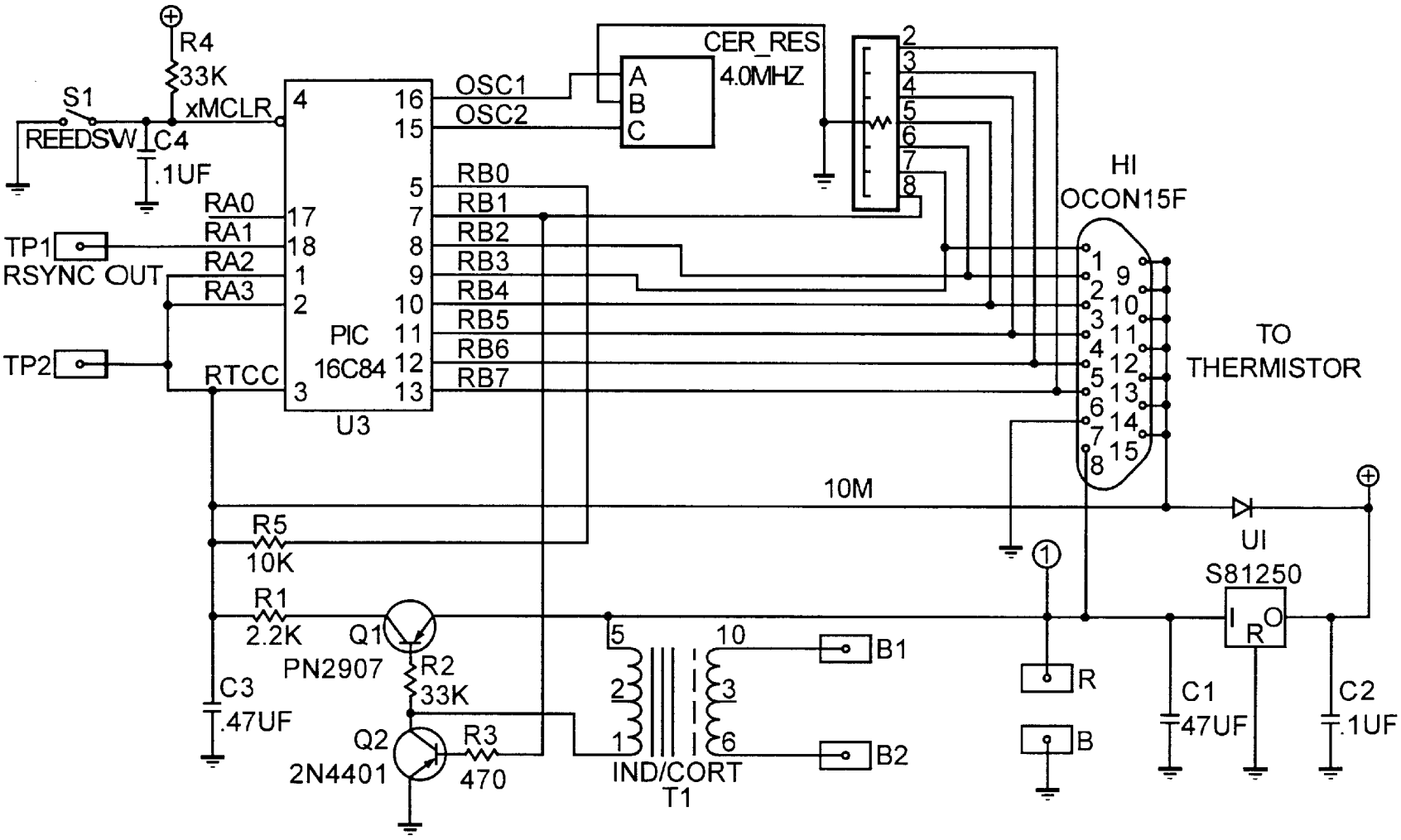
FIG. 3 is a detailed circuit diagram of the temperature monitoring unit of FIG. 2.

Referring now to FIG. 2, exemplary embodiments of the temperature monitoring unit 120 and the central processing unit 130 of the temperature monitoring apparatus are illustrated. The temperature monitoring unit 120 includes a housing 150, one or more temperature sensing devices 152, a processing unit or controller 154 and a power supply or source 165. The temperature monitoring unit may also include either an output device 156 or a transmitting unit 158, or both. An exemplary circuit diagram of the temperature monitoring unit 120 is illustrated in FIG. 3. Although the temperature monitoring unit 120 is shown as being constructed with various types of independent and separate units or devices, the temperature monitoring unit 120 can be implemented by one or more integrated circuits, or a microprocessor or microcontroller which may be programmed to execute the operations or functions equivalent to those performed by the circuits or units shown. It will also be recognized that the unit can be carried out in the form of hardware components and circuit designs, software or computer programming, or a combination thereof.

The housing 150 of the temperature monitoring unit 120 preferably has a general rectangular configuration and is constructed from a heat resistant material. As those skilled in the art will recognize, the size and shape of the housing 150 may be any suitable configuration and the housing 150 may be made from a variety of materials without departing from the spirit and scope of the invention.

The sensing devices 152 of the temperature monitoring unit 120 are preferably attached to the housing 150. The sensing devices 152 generate signals indicative of the temperature in the surrounding environment and provide the temperature signals to the processing unit 154. The sensing devices 152 are preferably thermistors, but can be any suitable temperature detecting device. It is also contemplated that the sensing devices may be incorporated into the service person's uniform, such as a coat, and electrically coupled to the temperature monitoring unit 120.

The processing unit 154 of the temperature monitoring unit 120 is operatively associated or electrically connected with the sensing devices 152 for receiving the temperature signals produced by the sensing devices 152. The processing unit is preferably a PIC16C84, available from Microchip Electronics. It is contemplated that the processing unit 130 can include a microprocessor or any other suitable device.

The processing unit 154 processes the signals from the sensing devices 152 in accordance with one or more programs or algorithms, as further described below. The processing unit 154 can continuously or periodically monitor one or more of the sensing devices 152 in any combination at any suitable frequency and duration. When the processing unit 154 determines that the temperature sensed by one or more of the sensing devices 152 is above a predetermined temperature level or the temperature is increasing at or above a predetermined rate, the processing unit 130, in one embodiment, can activate the output device 156, such as an audible and/or visual alarm to indicate hazardous conditions. It is also contemplated that the service persons may manually initiate a warning (i.e., audible and/or visual) by activating a switch (not shown) on the temperature monitoring unit 20.

The output device 156 of the temperature monitoring unit 120 is electrically connected or coupled to the processing unit 154. The output device 156 is preferably an audible signal horn alarm. When predetermined temperature conditions are detected, that is, when the temperature exceeds a predetermined level or when the rate of increase in the temperature exceeds a predetermine level, the processing unit 154 can activate the alarm. The output device 156 can indicate the temperature at various increments (i.e., 100°, 150°, 200°, 250°, and 300°) with distinct audible tones for easy interpretation. It is contemplated that the output device 156 may also provide other sensory warnings (i.e., strobe lights, vibrating device, etc).

The power source 165 of the temperature monitoring unit 120 supplies power to the processing unit 154. The power source 160 is preferably a 9-volt battery. It will be recognized that the power source 160 may be any suitable power source (i.e., rechargeable battery, fuel cell, nuclear sources).

Alternatively, or in addition to the activation of an alarm, the temperature monitoring unit 120 can send or transmit signals via the transmitting unit 158 to a central processing unit 130 to alert off-site personnel of temperature conditions in the environment as further described below. The transmitting unit 158 preferably includes a transmitter 160 and an antenna 162. The transmitter 160 is preferably an HX2000 available from RF Monolithics, Inc. It is also contemplated that the temperature monitoring unit 120 may include a receiver unit 164 to receive signals from the central processing unit 130.

The central processing unit 130 of the monitoring apparatus receives signals from the temperature monitoring unit 120 to monitor the temperature conditions in the various environments. The central processing unit 130 can be a portable computer or any other suitable device.

As shown in FIG. 2, the central processing unit 130 preferably includes a receiving unit 170, a processing unit or controller 172, an output device 174, an input device 176, and a power source or supply 178. Although the central processing unit 130 is shown as being constructed with various types of independent and separate units or devices, the central processing unit 130 can be implemented by one or more integrated circuits, or a microprocessor or microcontroller which may be programmed to execute the operations or functions equivalent to those performed by the devices or units shown. It will also be recognized that the unit can be carried out in the form of hardware components and circuit designs, software or computer programming, or a combination thereof.

The receiving unit 170 of the central processing unit 130 receives signals from the temperature monitoring units 120 and 122. The receiving unit 170 preferably includes a receiver 171 and an antenna 173. The receiver 171 is preferably an RX220 available from RF Monolithics. It is also contemplated that the central processing unit 130 may include an RF transmitter unit 180 (i.e., a 900 MHZ radio) to transmit signals to the temperature monitoring unit 120.

The processing unit 172 of the central processing unit 130 is electrically connected or coupled to the receiving unit 170. The processing unit 172 processes the signals received via the receiving unit 170 from the temperature monitoring unit 120 to determine the conditions in the environment. The processing unit 172 is preferably a PC compatible laptop, available from Gateway. It is contemplated that the processing unit 172 can include a microprocessor or any other suitable device.

When the processing unit 172 determines that the temperature in one of the environments is above a predetermined temperature level or the temperature is increasing at or above a predetermined rate, the processing unit 172 preferably activates the output device 174, such as an audible and/or visual alarm to warning off-site personnel of potential or actual hazardous conditions in one or more of the environments. A trouble or status message can be displayed on the output device 174. The central processing unit 130 may also transmit a signal to the temperature monitoring unit 120 to activate an alarm to warn on-site personnel of temperature conditions.

The processing unit 172 can identify the particular temperature monitoring unit 120 that the central processor unit 130 is monitoring. The processing unit 172 may also identify the particular locations or positions of the temperature monitoring unit 120 in the environment that the units are operating. The processing unit 172 may also generate a temperature profile of the temperature conditions within the environments, and the temperature conditions may be permanently recorded or printed.

The input device 176 of the central processing unit 130 is preferably electrically connected or coupled to the processing unit 172. Preferably, the input device 176 includes a keyboard or a keypad, but can include any suitable input device. The input device 176 can allow a number of versatile control or scanning functions to be utilized. For example, one or more of the temperature monitoring units 120 may be selected for continuous monitoring and the scanning frequency and duration of all or a selected number of temperature monitoring units may be initially preset and/or changed.

The output device 174 can provide warnings to alert an off-site operator of hazardous temperature conditions in the environments. The output device 174 can generate a message or an alarm that can be visual, audible, or both when hazardous temperature conditions are detected. The output device 174 can also numerically display the temperatures and the rate of change of the temperature in each of the environments. The output device 174 is preferably a LCD display, but can be any suitable device.

The power source 178 supplies power to the components of the temperature monitoring unit 130. The power source 178 is preferably a 9-volt battery. It will be recognized that the power source 178 may be any suitable power source (i.e., rechargeable batteries, fuel cells, nuclear sources).

A detailed circuit diagram of the logic circuit used in the temperature sensing circuit of the present invention is illustrated in FIG. 3. Using this logic circuit, the temperature at the temperature sensors is measured and the rate of increase in the temperature is calculated and then used to estimate the time at which the temperature of the environment has exceeded a predetermined level. When the estimate of time is such that the environment may cause injury, the alarm will be activated.

In the logic circuit shown in FIG. 3, to determine the temperature, a known voltage is applies through the varying resistance of the thermistors to charge a capacitor and measure the time required for the voltage across the capacitor to reach a preset value. In the embodiment of FIG. 3, C3 is the measuring capacitor. Pin 6 of U3, a microprocessor, is used to apply a known voltage to C3 through R5, a known resistance. The charging time is measured by pin 3 of U3.

The known voltage is applied, each in turn, through the thermistors connected to connector Hi and then to C3. By measuring the time to charge C3 with an unknown resistance and a known resistance, a ratio can be determined that indicates the value of the unknown resistance and the temperature at the thermistors. Pins 1 and 2 of U3 are used to discharge C3 between measurements.

A large value resistance may be placed in parallel with each thermistor to allow a measurement time indicative of a disconnected thermistor. To measure the battery voltage, a known resistance, R1, and a transistor switch, Q1, may also be provided. An asynchronous output at pin 18 of U3 may be provided to connect to a data transmission device, such as a 900 MHZ radio, or other monitoring devices. The output can also be used for computer testing and calibration.

Figure 4:
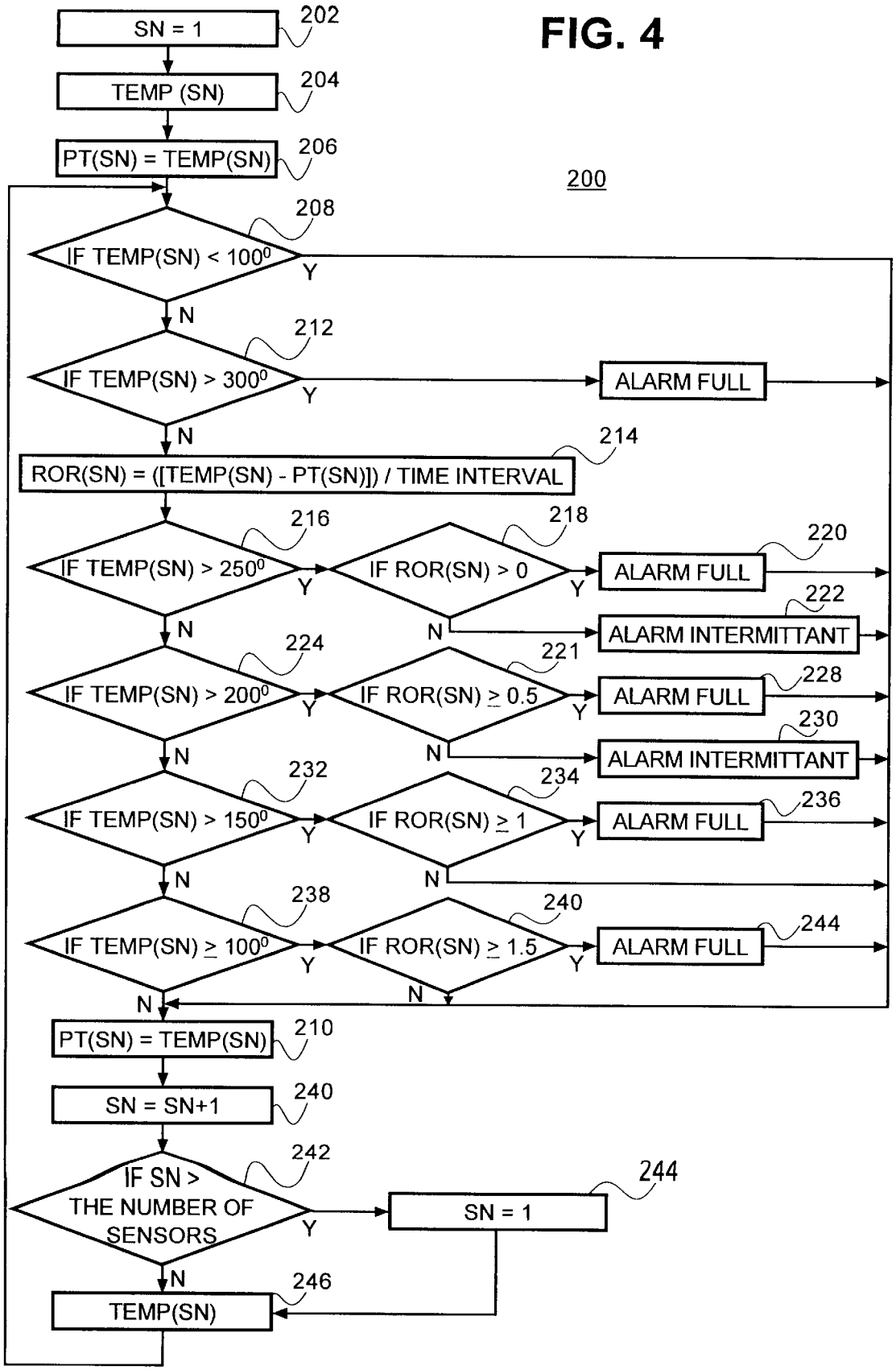
FIG. 4 is a flow diagram of a routine implemented by the temperature monitoring unit of FIG. 2.

Referring now to FIG. 4, a flow diagram of a routine or process 200 implemented by the temperature monitoring unit 120 is illustrated. It is also contemplated that the central processing unit 130 may utilize this process 200.

At block 202, the selected sensor number SN is set equal to 1. The temperature monitoring unit then senses or reads the temperature of the selected sensor, and the current temperature value TEMP(SN) is set equal to the temperature of selected sensor at block 204. At block 206, the previous temperature value PT(SN) is set equal to the current temperature value TEMP(SN). The unit then determines if the current temperature value TEMP(SN) is less than 100° at block 208.

If the current temperature value TEMP(SN) is less than a 100°, the process proceeds to block 210 as further described below. If the current temperature value TEMP(SN) is not less than a 100°, the unit determines whether the current temperature value TEMP(SN) is greater than 300° at block 212.

If the current temperature value TEMP(SN) is greater than 300°, the unit activates a full alarm and the process proceeds to block 210. If the current temperature value TEMP(SN) is not greater than 300°, the unit determines the rate of temperature rise ROR(SN). The rate of temperature rise ROR(SN) is calculated by the following formula: [(current temperature value TEMP(SN)−previous temperature value PT(SN))÷time interval]. The rate of temperature rise can be expressed as the slope of the equation: slope= Y/X.

At block 216, the unit determines whether the current temperature value TEMP(SN) is greater than 250°. If the current temperature value TEMP(SN) is greater than 250°, the unit determines if the rate of rise ROR(SN) is greater than 0 at block 218.

If the rate of temperature rise ROR(SN) is greater than 0, the unit activates a full alarm condition at block 220, and the process then proceeds to block 200. If the rate of rise ROR(SN) is not greater than 0, the unit activates an intermittent alarm at block 222.

If the current temperature value TEMP(SN) is not greater than 250° at block 216, the unit determines if the current temperature value TEMP(SN) is greater than 200° at block 224. If the current temperature value TEMP(SN) is greater than 200°, the unit determines if the rate of temperature rise ROR(SN) is greater than or equal to 0.5 at block 226.

If the rate of rise is greater than 0.5, the unit will activate a full alarm condition at block 228, and the process proceeds to block 200. If the rate of rise ROR(SN) is not greater than or equal to 0.5, the unit will activate an intermittent alarm at block 230, and the process then proceeds to block 210.

If the current temperature value TEMP(SN) is not greater than 200° at block 224, the unit determines whether the current temperature value TEMP(SN) is greater than 150° at block 232. If the current temperature value is greater than 150°, the unit determines whether the rate of temperature rise ROR(SN) is greater to or equal to 1 at block 234.

If the rate of temperature rise ROR(SN) is greater than or equal to 1, the unit activates a full alarm condition at block 236, and the process then proceeds to block 210. If the rate of rise is not greater than or equal to 1, the process proceeds directly to block 210.

If the current temperature value TEMP(SN) is not greater than 150°, the unit determines whether the current temperature value TEMP(SN) is greater than or equal to 100° at block 238. If the current temperature value TEMP(SN) is greater than or equal to 100°, the unit determines whether the rate of temperature rise ROR(SN) is greater to or equal to 1.5 at block 240.

If the rate of rise is greater than or equal to 1.5, the unit activates a full alarm condition at block 244, and the process then proceeds to block 210. If the rate of temperature rise is not greater than or equal to 1.5, the process proceeds directly to block 210.

If the current temperature value TEMP(SN) is not greater than or equal to 100° at block 238, the previous temperature value PT(SN) is set equal to the current temperature value TEMP(SN) at block 210. The selected sensor number SN is set equal to the selected sensing number SN+1 at block 240. The unit then determines whether the selected sensing number SN is greater than the number of sensing devices at block 242.

Figure 5:
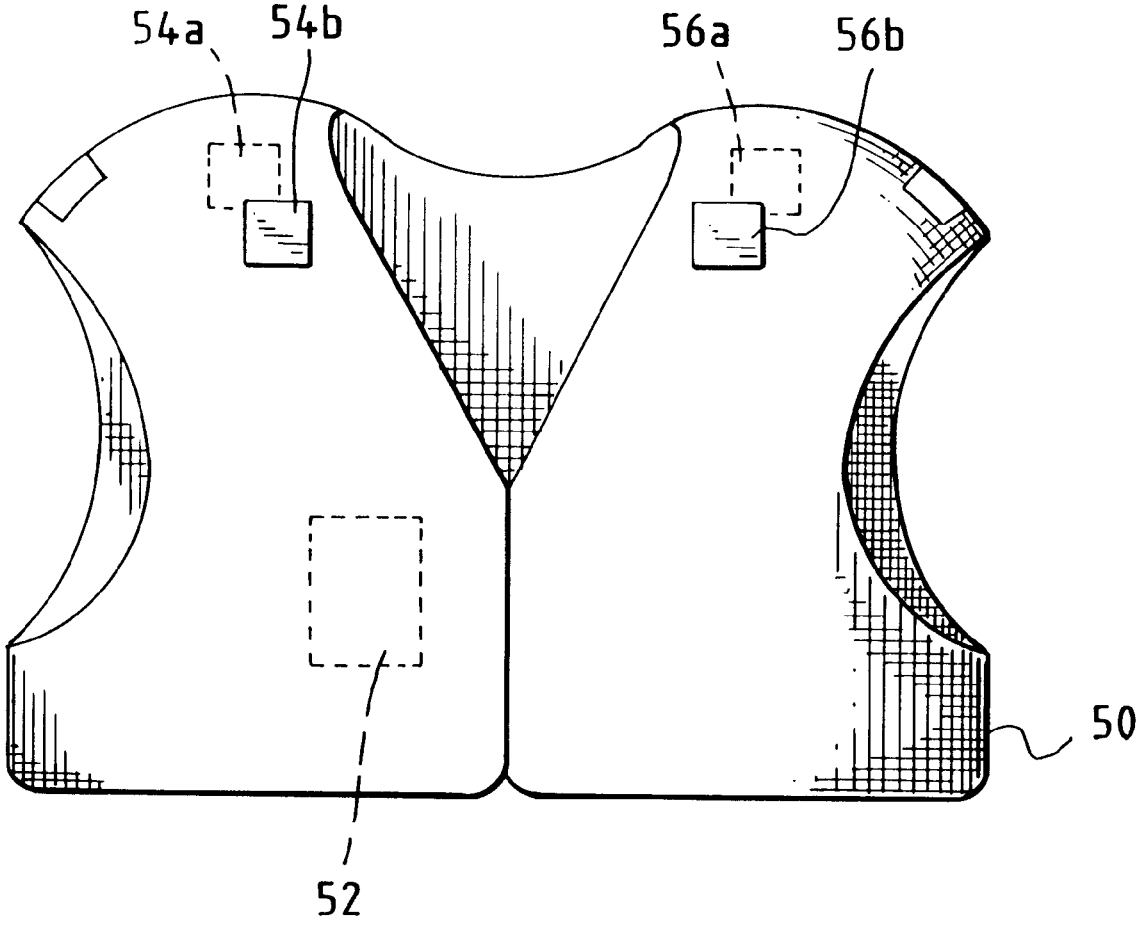
FIG. 5 is a perspective view of a vest to be placed within a firefighter's coat as another embodiment of the present invention.

If the selected sensor number SN is greater than the number of sensing devices, the selected sensing number SN is set equal to 1 at block 244, and the process then proceeds to block 246 as further described below. If the selected sensor number SN is not greater than the number of sensing devices, the unit senses or reads the temperature of the selected sensor at block 246. The process then proceeds to block 208 as described above. FIG. 5 illustrates yet another embodiment of the present invention.

As an alternative to positioning the temperature monitoring system in the firefighter's coat of FIG. 1, a vest 50 containing the temperature monitoring system is illustrated in FIG. 5. The vest 50 of FIG. 5 can be placed within the firefighter's turnout coat of FIG. 1 between the exterior heat resistant shell 12 and the interior lining 14. The vest 50 is adapted to hold and allow access to an electronic circuit housing 52. The vest 50 includes four temperature sensors 54*a*, 54*b*, 56*a* and 56*b*, located either on the interior or exterior surfaces of the vest. The temperature sensors are connected to an electronic sensing circuit (not shown) within the electronic sensing circuit housing 52 by means of electrical connectors (not shown). An electronic speaker or alarm warning device is located on or within the electronic sensing circuit housing 52. The temperature monitoring system illustrated in FIG. 2 and FIG. 3 can be implemented in the same manner as the embodiment of FIG. 1.

Figure 6:
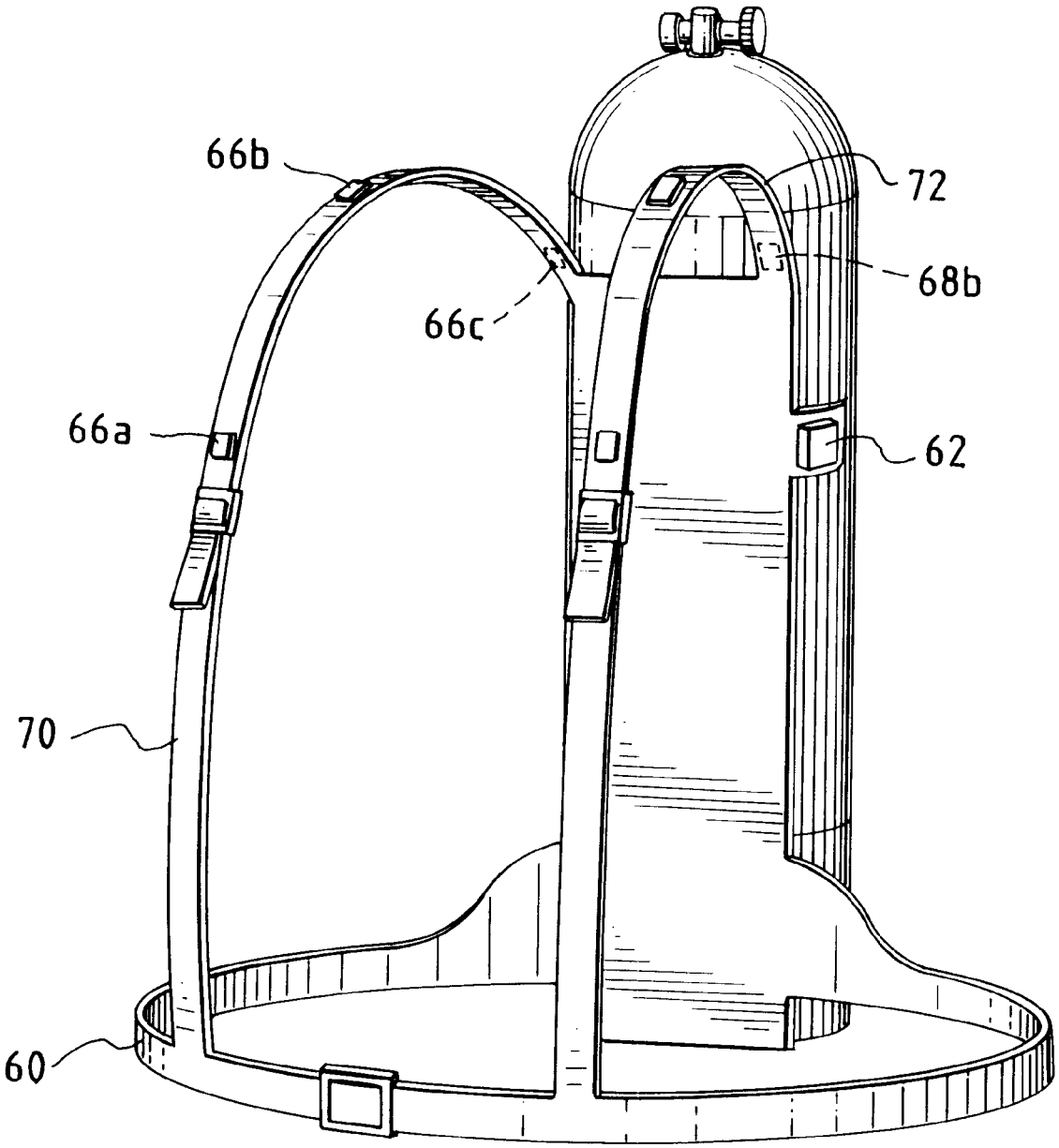
FIG. 6 is a perspective view of still another embodiment of the present invention in which the monitoring system is placed on a self-contained breathing apparatus.

FIG. 6 illustrates yet another alternative to the embodiment of FIG. 1 and FIG. 5, namely a self-contained breathing apparatus equipped with the temperature monitoring system of the present invention. The self-contained breathing apparatus 60 of FIG. 6 is worn by the firefighter over the firefighter's turnout coat 10 of FIG. 1. An electronic circuit housing 62 is mounted on the oxygen tank 64 of the self-contained breathing apparatus 60. Temperature sensors 66*a*, 66*b*, 66*c*, 68*a* and 68*b* are positioned on straps 70 and 72 of the self-contained breathing apparatus 60. The temperature sensors are connected to an electronic sensing circuit (not shown) within the electronic sensing circuit housing 62 by means of electrical connectors (not shown). An electronic speaker or alarm warning device is located on or within the electronic circuit housing 62. The temperature monitoring system illustrated in FIG. 2 and FIG. 3 can be implemented in the same manner as the embodiments of FIG. 1 and FIG. 5.

Although the present invention has been described in detail by way of illustration and example, it should be understood that a wide range of changes and modifications can be made to the preferred embodiments described above without departing from the scope and spirit of the invention. Thus, the described embodiments are to be considered in all respects only as illustrative and not restrictive, and the scope of the invention is, therefor, indicated by the appended claims rather than the forgoing description. All changes that come within the meaning and range of equivalency of the claims are to be embraced within their scope.

What is claimed:

1. A firefighter's turnout coat comprising a body portion attached to enclose the torso of a firefighter and pair of arms extending from the body portion, each of the body portion and the arms being formed of a heat resistant fabric exterior shell, an interior lining within the body portion and the arms; an electronic temperature sensing circuit positioned within the coat, the electronic temperature sensing circuit including a processing unit responsive to at least one temperature sensor to detect successive representations of a plurality of temperatures at preselected time intervals whereby the processing unit determines the rate of increase between successive representations of temperature and compares the rate of temperature increase to at least one predetermined threshold, and an alarm to provide a warning when the rate of temperature increase exceeds the predetermined threshold.

2. The turnout coat of claim 1 wherein the temperature sensor is a thermistor and the alarm is a piezo electric speaker.

3. The turnout coat of claim 1 wherein said processing unit includes a transmitter for sending signals to a remote station, said remote station further including a receiver for receiving said signals and a central processing unit which provides an alarm signal at the remote station when the rate of temperature increase exceeds said predetermined threshold.

4. A vest for use with a firefighter's turnout coat having a heat resistant fabric exterior shell and an interior lining, said vest being located between the exterior shell and interior lining of said turnout coat, an electronic temperature sensing circuit positioned within said vest, the electronic temperature sensing circuit including a processing unit responsive to at least one temperature sensor to detect successive representations of a plurality of temperatures at preselected time intervals whereby the processing unit determines the rate of increase between successive representations of temperature and compares the rate of temperature increase to at least one predetermined threshold, and an alarm to provide a warning when the rate of temperature increase exceeds the predetermined threshold.

5. The vest of claim 4 wherein the temperature sensor is a thermistor an the alarm is a piezo electric speaker.

6. The vest of claim 4 wherein said processing unit includes a transmitter for sending signals to a remote station, said remote station further including a receiver for receiving said signals and a central processing unit which provides an alarm signal at the remote station when the rate of temperature increase exceeds said predetermined threshold.

7. A self-contained breathing apparatus used with firefighter's turnout coat having a heat resistant fabric exterior shell and an interior lining; an electronic temperature sensing circuit positioned on said self-contained breathing apparatus, the electronic temperature sensing circuit including a processing unit responsive to at least one temperature sensor to detect successive representations of a plurality of temperatures at preselected time intervals whereby the processing unit determines the rate of increase between successive representations of temperature and compares the rate of temperature increase to at least one predetermined threshold, and an alarm to provide a warning when the rate of temperature increase exceeds the predetermined threshold.

8. The self-contained breathing apparatus of claim 7 wherein the temperature sensor is a thermistor and the alarm is a piezo electric speaker.

9. The self-contained breathing apparatus of claim 8 wherein said processing unit includes a transmitter for sending signals to a remote station, said remote station further including a receiver for receiving said signals and a central processing unit which provides an alarm signal at the remote station when the rate of temperature increase exceeds said predetermined threshold.

* * * * *